United States Patent [19]

Ashton

[11] 4,313,544

[45] Feb. 2, 1982

[54] DISPLAY RACK

[76] Inventor: Richard D. A. Ashton, R.R. 1, Terra Cotta, Ontario, Canada

[21] Appl. No.: 157,445

[22] Filed: Jun. 9, 1980

Related U.S. Application Data

[62] Division of Ser. No. 962,168, Nov. 20, 1978, Pat. No. 4,226,190.

[51] Int. Cl.[3] ..... A47F 5/01; A47F 5/16

[52] U.S. Cl. ..... 211/181; 108/27; 108/28; 108/111; 211/182; 211/191

[58] Field of Search ..... 108/27, 28, 91, 111, 108/55.1; 312/210, 262, 196, 114; 297/248; 211/181, 191, 182, 184, 192

[56] References Cited

U.S. PATENT DOCUMENTS

| | | | |
|---|---|---|---|
| 1,235,679 | 8/1917 | Gerberich | 108/114 |
| 2,305,244 | 12/1942 | Erickson | 108/27 X |
| 2,680,522 | 6/1954 | Temple | 211/181 X |
| 3,079,206 | 2/1963 | Glezen | 108/91 |
| 3,115,106 | 12/1963 | Gersch | 108/91 X |
| 3,184,075 | 5/1965 | Cohen | 108/91 X |
| 3,232,442 | 2/1966 | Wilson | 211/181 X |
| 3,695,694 | 10/1972 | Mohr | 297/248 |
| 3,717,259 | 2/1973 | Fried | 211/181 X |
| 4,117,783 | 10/1978 | Eckel | 108/91 |

FOREIGN PATENT DOCUMENTS

| | | | |
|---|---|---|---|
| 1291175 | 3/1962 | France | 312/210 |

*Primary Examiner*—James T. McCall

*Attorney, Agent, or Firm*—George A. Rolston; William F. Frank

[57] ABSTRACT

A display rack having a back wall, and at least two side walls, and having hinge means interconnecting between respective side walls and the back wall, such hinge means being located at spaced apart intervals whereby the side walls may be swung flat against the back wall for shipping, and may be swung away therefrom for erection, and having shelving dimensioned to fit between the two side walls when the same are swung apart and the shelving having fastening means integral therewith interengageable with the side walls whereby the shelving may be secured along either side edge to respective side walls, in supporting relation thereto, and at the same time interlocking such side walls together in predetermined spaced apart relation so that they are no longer swingable with respect to the back wall, and forming a rigid three-dimensional structure.

6 Claims, 7 Drawing Figures

DISPLAY RACK

This is a division of application Ser. No. 962,168 filed Nov. 20, 1978, now U.S. Pat. No. 4,226,190.

This invention relates to portable dismountable racks of shelving for the display and sale of merchandise.

BACKGROUND OF THE INVENTION

A great variety of different designs of display racks for merchandise have been proposed, which satisfy various objectives. Thus it is desirable both to display the merchandise attractively, and also to provide an actual point of sale, whereby the merchandise can be sold directly off the display, and thus incorporates its own storage capacity, and it is desirable also to incorporate some form of advertising display at such point of sale.

In addition to all of these factors however which are more or less self-evident, and in the past, have been achieved to a certain extent in a variety of different ways, it is also desirable that when setting up a new sales programme, the manufacturer or supplier shall be able to provide to the vendor or retailer a complete package consisting of an inventory of the merchandise itself, and also display racks particularly designed to both display and sell the product with the maximum of customer appeal.

For bulky merchandise, in this particular case wallpaper, the construction, of large display racks following conventional techniques sufficient to hold quantities of wallpaper, and the shipping and erection of such racks, would be prohibitively expensive and require skilled labour.

It is particularly desirable that the display racks shall be especially designed to suit the particular characteristics of rolled wallpaper, and at the same time, shall be capable of being shipped out in a dismounted condition, and may be set up in a retail outlet with a minimum of skill i.e. by sales help available in the location, and without of any tools whatever.

BRIEF SUMMARY OF THE INVENTION

The invention seeks to provide the foregoing features, and comprises a display rack having a back wall, and at least two side walls, and having hinge means interconnecting between respective side walls and the back wall, such hinge means being located at spaced apart intervals whereby the side walls may be swung flat against the back wall for shipping, and may be swung away therefrom for erection, and having shelving dimensioned to fit between the two side walls when the same are swung apart and the shelving having fastening means integral therewith interengageable with the side walls whereby the shelving may be secured along either side edge to respective side walls, in supporting relation thereto, and at the same time interlocking such side walls together in predetermined spaced apart relation so that they are no longer swingable with respect to the back wall, and forming a rigid three-dimensional structure.

Preferably, the invention further comprises that there are two outer side walls, and at least one intermediate side wall, so that at least two adjacent sets of shelves may be arranged therebetween, with the intermediate side wall separating one such set of shelves from the next adjacent set.

Preferably, the invention further comprises that display panel means are also provided, comprising a display back wall and two display side walls, and hinge means between the side walls and the back wall whereby the same may be swung flat against the back wall for shipping, and may be swung open for display, the back wall of the display being essentially co-extensive with the back wall of the shelving, and the side walls of the display being essentially co-extensive with the side walls of the shelving, and there being supporting means on said support panels for supporting display cards thereon, and the display side walls having interlock means on their lower edges, and the shelving side walls having interlock means on their upper edges, such interlock means being interengageable whereby the said display side walls may be mounted vertically above the shelving side walls. In this way a rigid three-dimensional structure is provided in which the shelving effectively secures the side walls and holds them rigidly in position, and the display walls are securely held in place.

The various features of novelty which characterize the invention are pointed out with particularity in the claims annexed to and forming a part of this disclosure. For a better understanding of the invention, its operating advantages and specific objects, attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
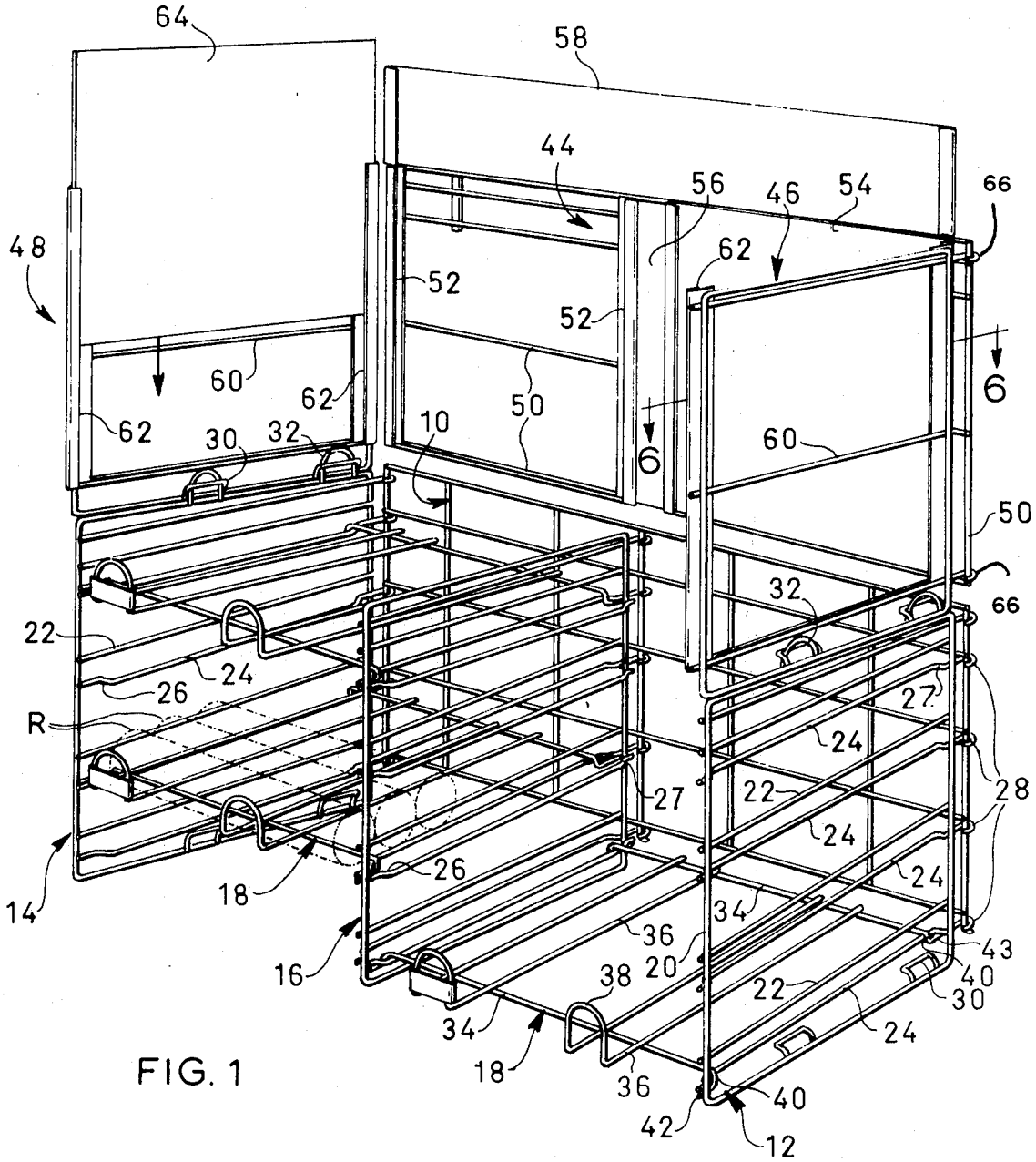
FIG. 1 is a front perspective illustration of a display rack according to the invention, shown with certain part thereof either disassembled or absent, for clarity.
Figure 2:
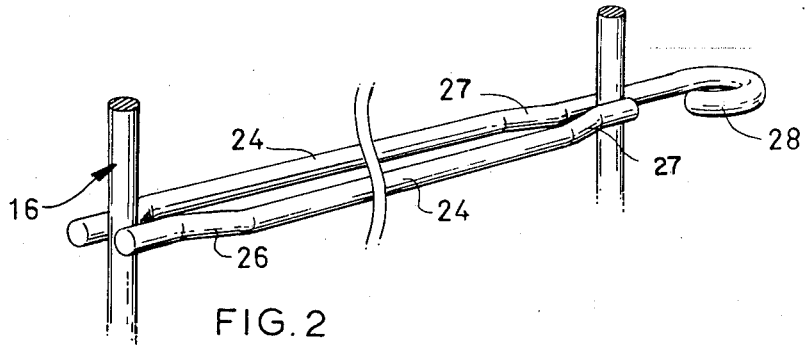
FIG. 2 is an enlarged detail of FIG. 1.
Figure 3:
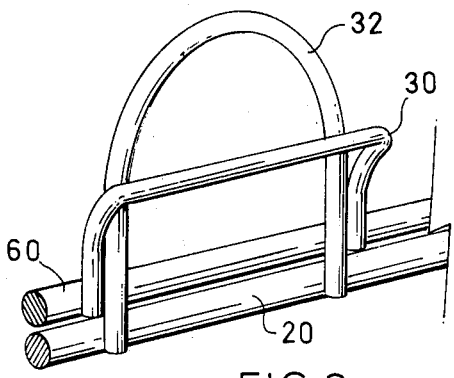
FIG. 3 is an enlarged cut away perspective illustration of the interlock means between the shelving side walls and the display side walls.
Figure 4:
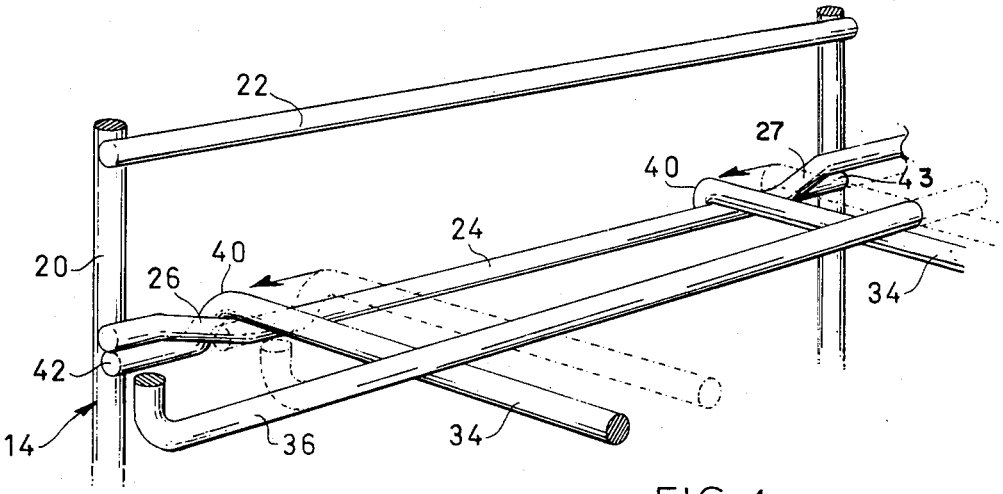
FIG. 4 is a cut away enlarged perspective of the shelving fastening means.
Figure 5:
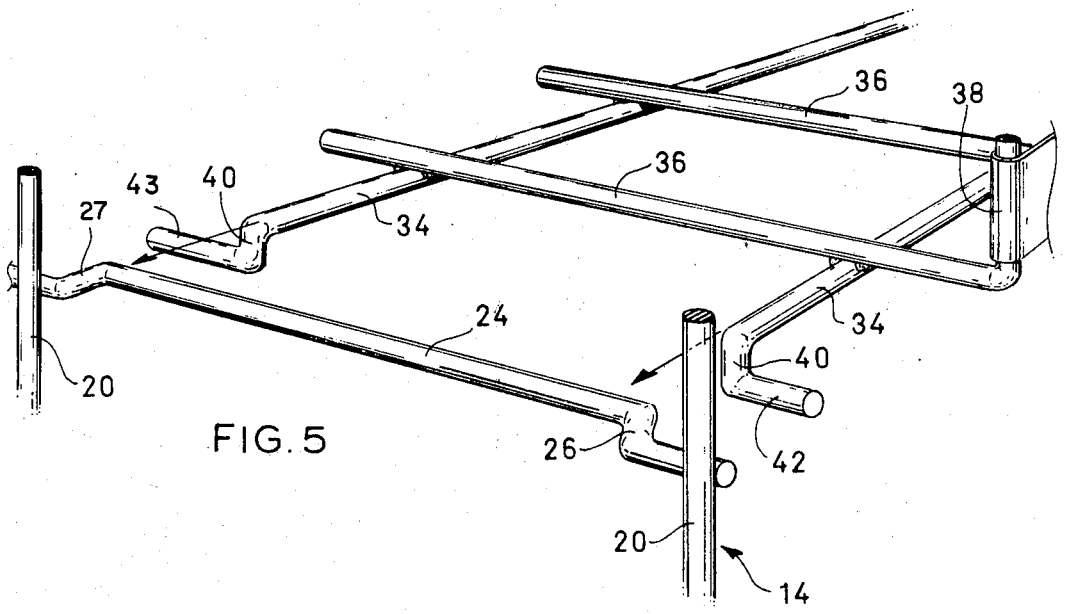
FIG. 5 is a view corresponding to FIG. 3, from another direction showing the two parts disassembled.
Figure 6:
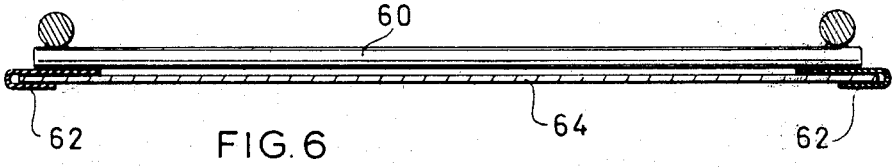
FIG. 6 is a fragmentary section along the line 5—5 of FIG. 1.
Figure 7:
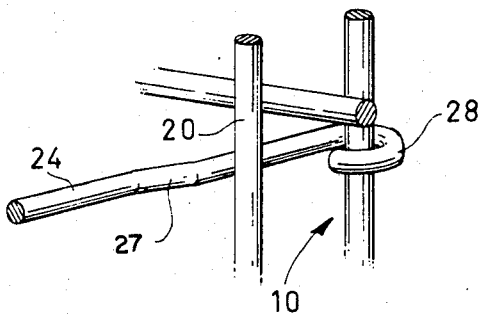
FIG. 7 is an enlarged perspective of the hinge means.

With reference first of all to FIG. 1, a display rack according to the invention is shown there and will be seen to comprise a shelving back wall 10, and shelving side walls 12 and 14 and an intermediate shelving side wall 16.

Shelving or racks 18 are supported between adjacent walls 12 and 16 and 14 and 16 respectively. Rolls R typically of wallpaper are shown in one of the shelves 18, the shelves 18 being downwardly angled, in a manner described hereinafter, whereby to ensure that the rolls advance to the front of the rack as they are purchased.

The shelving 18 will be of sufficient strength and depth that rolls R may be stacked two or three rolls deep, for greater storage capacity.

The back wall 10 will be seen to be constructed of a wire grid consisting of horizontal and vertical components, being spot welded to one another in a manner known per se and requiring no further description.

The outer side walls 12 and 14 are constructed in an identical, but mirror image manner. Thus the side wall 12 comprises a rectangular wire frame member 20, having a plurality of transverse shorter guide bars 22, and a plurality of longer support bars 24, spot welded thereto in spaced apart parallel relation as shown. The guide bars 22 are simply straight wire rods and perform a guide function locating the rolls R on the shelves 18. The longer support bars 24 are formed with two generally Z-shaped off-sets or bends indicated as 26 and 27, at opposite ends thereof adjacent to two vertical portions of the square frame 20, the rearward offset 27 being longer than the forward offset 26.

The rearwardly extending portion of each of rods 24 is formed into a loop or eye 28, which fits loosely around the vertical portion of the back wall 10, to provide a hinging action.

The intermediate or median side wall 16 comprises rectangular wire frame work 29, and similar guide bars 22, and longer support bars 24. However, it will be noted that support bars 24 are welded in pairs on opposite sides of frame 29, with one only of each pair having a loop 28 thereon, for hinging attachment to back wall 10.

In order to provide vertical interconnection, along the upper and lower edges of the side walls 12 and 14, for interconnection with the display panels or other similar shelving walls such as another back wall 10 and side walls 12 and 14, there are provided lower and upper interconnection means. The lower interconnection means on each of side walls 12 and 14 comprises more or less rectangularly shaped wire eyelets 30, the upper portions of which are turned inwardly, whereby the interior of the eyelet 30 may be penetrated in a vertical plane.

The upper interlocking means comprise generally D-shaped wire insert members 32, arranged in a vertical plane. The lower interconnection means namely the eyelets 30 are attached to the lower horizontal portion of the frames 20, and the upper interconnection means namely the C-shaped inserts 32 are fastened to the upper horizontal portion of frames 20. The inserts 32 are somewhat narrower than the eyelets 30, whereby the inserts 32 may be inserted, in a vertical plane, into corresponding eyelets 30 on the lower edges of the display walls described below.

Each shelf 18 is identical, and comprises a pair of transverse rods 34, and two pairs of longitudinal rods 36, joined at their forward ends and turned upwardly as at 38.

At each end of the transverse rods 34, the end of the rod is bent substantially vertically downwardly, at an intermediate section 40 and is then bent outwardly, through a right angle relative to the axis of the rod 34, to provide forward hook portion 42, and longer rearward hook portion 43.

The hooks 42 and 43 are interengageable with the Z-shaped offsets 26 and 27 of rods 24 and provide a rigid locked interconnection both at the front and back of each of shelves 18, with adjacent side walls 12 and 16 and 14 and 16 respectively.

Locking of the shelves 18 is achieved in three movements.

A. The shelf is held at an angle, with the rear lower than the front, and the longer hooks 43 are inserted around the rearward longer offsets 27, but inside the adjacent vertical portions of the rectangular frames.

B. The shelf is then swung down until the forward hooks 42 pass around the forward offsets 26.

C. The shelf is then drawn forwardly so that the forward hooks 42 pass inside the adjacent vertical portions of the rectangular frames, and the shelf is then locked. It will be noted that the longer offsets 27 provide space for such forward movement, while the longer hooks 43 are of such length that they continue to engage the rectangular frames, even when the shelf is drawn forwardly.

In this way, each shelf is secured at all four corners in a rigid manner, and the engagement of the hooks with the rectangular frames prevents any twisting movement of the side walls relative to the shelving.

It will of course be appreciated that the arrangement of the shelving side walls and intermediate wall may be varied in order to provide either smaller or larger displays, although the particular arrangement shown with two sets of shelving 18, supported by the two side walls 12 and 14 and the intermediate wall 16 is particularly suitable and effective and provides a good rigid display.

It will also be understood that if desired a second tier (not shown) of a shelving back wall, and side walls, and shelving, may be stacked on top of the first tier, being fastened by the interconnecting means described above. In this way double the storage capacity is provided without detracting from the usefulness or appeal of the first shelving tier.

In order to provide point of sale advertising and instructions to purchasers, an upper advertising display back wall 44 is provided, having two display side walls 46 and 48.

The display back wall 44 comprises a framework of vertical and horizontal rods 50, which in this case extends the same width as the width of the shelving back wall 10.

In order to support display advertising material, four vertical channel members 52 are fastened on the front of the frame 50, in two pairs, so that two separate display cards 54 can be slid between respective pairs of such channels 52. Typically such display cards will be of suitable cardboard material, printed with instructions for use in advertising or the like, and may be changed from time to time depending upon the sales program currently in effect.

A median sheet metal panel 56 is located between the two pairs of channels 52, which may be permanently printed with further advertising material, or may serve as a support for advertising printed on adhesive backed paper or the like.

Similarly, a further upper display panel 58, also of sheet metal is provided along the upper edge of the frame 50 for carrying further advertising.

The display side walls 46 and 48 are of essentially the same construction as the back wall 44. They will thus be seen to comprise a wire framework 60, and spaced apart vertical metal channel 62, display card 64 may be slid between the channel 62.

Along the lower portion of each of frame 60, further connection eyes 30 are provided, for interconnection with the upstanding loops 32 on the upper edges of the shelving side walls 12 and 14.

There is no specific connection provided between the shelving back wall 10 and the display back wall 44.

Hingeable connections are effected between the display back wall 44 and the side walls 46 and 48, by means of wire loops 66.

In this way, the entire structure of the display back wall 44 and side walls 46 and 48 may be folded flat upon itself, for ease of shipping and storage. When folded flat, the entire structure will be relatively slim, and can easily be stored in a warehouse, and shipped out to customers as required, at a minimum cost.

Once erected however, and filled with product for sale, it forms an attractive rigid self supporting free standing display structure, which provides an attractive and at the same time efficient addition to the retail store. In particular, the entire structure being made of open frames, utilizing the inherent advantages of wire rod frame work, which combines both strength with a maximum of open area, ensures two factors, mainly that the customers may view the actual product in the shelfs from various directions and thus be attracted to the display, without necessarily viewing it from in front, and at the same time provides an easy means whereby sales staff can readily check inventory of particular items, thereby ensuring that items do not become out of stock.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Display rack, for use in association with merchandise storage means, having shelving for the storage of merchandise thereon, said display rack being adapted to be located above said shelving for supporting display panels showing merchandise information thereon, said display rack comprising;

back support frame means, having side edges and top and bottom edges;

side support frame means connected with said back support frame means along both side edges thereof, said side support frame means having side edges and top and bottom edges;

means for connecting said side frame means to said back support frame means, to form a generally three-sided rectangular structure;

interlocking attachment means on some of said frame support members, for interengagement with said shelving, whereby the same may be erected thereabove, and, elongated channel members fastened in parallel spaced apart location on opposite side edges of said side frame support means and of said back frame support means, defining opposed open grooves, for reception of opposite side edges of said display panel means therein.

2. Display rack as claimed in claim 1 including hinge means connecting said side support frames to said back support frame whereby the same may be swung together for shipping and storage.

3. Display rack as claimed in claim 1 including upper support means located above one of said support frame means, and including separate display panel attachment means thereon.

4. Display rack as claimed in claim 1 wherein said back support frame means is provided with two pairs of channel members thereon in side by side location whereby two separate display panels may be displayed on one back support frame means in side by side relation.

5. Display rack as claimed in claim 1 wherein said shelving includes generally upwardly directed male connector members, and including inwardly directed female connector members on the lower edges of said side support frame members for registration with said male connector members on said shelving.

6. Display rack as claimed in claim 1 wherein said back and side support frame means are formed of wire rod construction and wherein said channel members are attached thereto in a common plane spaced forwardly of their respective frame means whereby display panels supported in said channel members overlie said support frame means.

* * * * *